US008747137B2

(12) United States Patent
Tashiro

(10) Patent No.: US 8,747,137 B2
(45) Date of Patent: Jun. 10, 2014

(54) CONNECTOR

(75) Inventor: Harunori Tashiro, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 167 days.

(21) Appl. No.: 13/383,514

(22) PCT Filed: Sep. 1, 2010

(86) PCT No.: PCT/JP2010/064914
§ 371 (c)(1),
(2), (4) Date: Jan. 11, 2012

(87) PCT Pub. No.: WO2011/027777
PCT Pub. Date: Mar. 10, 2011

(65) Prior Publication Data

US 2012/0115356 A1 May 10, 2012

(30) Foreign Application Priority Data

Sep. 1, 2009 (JP) ..... 2009-201643

(51) Int. Cl.
*H01R 13/52* (2006.01)

(52) U.S. Cl.
USPC ..... 439/271; 277/598

(58) Field of Classification Search
USPC ..... 439/271, 272, 278, 281, 538, 548, 556, 439/559, 587, 89; 277/598, 637, 630, 351, 277/397, 396.33; 285/133.21, 299, 918, 285/123.6, 196, 336
See application file for complete search history.

(56) References Cited

U.S. PATENT DOCUMENTS

| | | | | |
|---|---|---|---|---|
| 6,257,592 | B1 * | 7/2001 | Hashizawa et al. | 277/596 |
| 6,338,651 | B1 | 1/2002 | Svette, Jr. et al. | |
| 6,953,357 | B2 * | 10/2005 | Fukushima et al. | 439/271 |
| 7,329,145 | B2 * | 2/2008 | Yagome et al. | 439/556 |
| 2004/0214464 | A1 | 10/2004 | Fukushima et al. | |

FOREIGN PATENT DOCUMENTS

CN 101453075 A 6/2009

(Continued)

OTHER PUBLICATIONS

European Search Report dated Feb. 21, 2013 issued by the European Patent Office in counterpart European Patent Application No. 10813726.6.
International Search Report (PCT/ISA/210) issued on Oct. 5, 2010 in the International Patent Application No. PCT/JP2010/064914.

(Continued)

*Primary Examiner* — Renee S Luebke
*Assistant Examiner* — Harshad Patel
(74) *Attorney, Agent, or Firm* — Sughrue Mion, PLLC

(57) ABSTRACT

A connector includes a packing which includes an annular body part, ear parts extending outward from the body part, and lock receiving parts provided in the ear parts. The connector further includes a case which includes an annular packing-mounted part provided on which a body part of the packing is mounted, a flange part which is integrally provided on the case body part to surround the packing-mounted part, a pair of through holes which are formed in the case body part to communicate between a face of the packing-mounted part and a back face of the flange part and through which the ear parts are respectively passed, and a pair of locking parts which are provided on the back face of the flange part and with which the lock receiving parts in the ear parts are respectively engaged.

5 Claims, 7 Drawing Sheets

(56) References Cited

FOREIGN PATENT DOCUMENTS

| | | | |
|---|---|---|---|
| DE | 20 2006 013 243 | U1 | 10/2006 |
| JP | 62-124781 | U | 8/1987 |
| JP | 8-250203 | A | 9/1996 |
| JP | 2004-327169 | A | 11/2004 |
| JP | 2006-48998 | A | 2/2006 |
| JP | 2006-59569 | A | 3/2006 |
| JP | 2006-140080 | A | 6/2006 |

OTHER PUBLICATIONS

Written Opinion (PSCT/ISA/237) issued on Oct. 5, 2010 in the International Patent Application No. PCT/JP2010/064914.
Office Action dated Oct. 28, 2013, issued by the European Patent Office in corresponding European Application No. 10 813 726.6.
Office Action and Search Report dated Nov. 22, 2013, issued by the State Intellectual Property Office of the P.R.C. in corresponding Chinese Application No. 201080038800.2.

* cited by examiner

CONNECTOR

TECHNICAL FIELD

The present invention relates to a connector, and more particularly, to a connector provided with waterproof property by employing a packing.

BACKGROUND ART

FIG. 5 is a perspective view of a connector 200 in a related art as seen diagonally from the back, FIG. 6 is a perspective view of the connector 200 as seen diagonally from the front, and FIG. 7 is a sectional perspective view of the connector 200 in FIG. 6.

The connector 200 in the related art is a connector for inverter which is directly attached to an inverter of an HEV (Hybrid Electric Vehicle), for example, and includes an aluminum case 202, a packing 204, and terminals 206.

The inverter of the HEV is disposed in an engine room of a vehicle, and must be reliably waterproofed. For this purpose, an annular packing 204 is provided on a front face of the connector 200 (or the aluminum case 202) at a position in contact with an inverter housing. By means of the packing 204, an interior of the aluminum case 202 in which the terminals 206 are provided is waterproofed. Because the aluminum case 202 is formed by die casting, using molds in the same manner as in resin molding, it is necessary to provide a draft.

The aluminum case 202 is formed of aluminum or aluminum alloy for the purpose of removing noises which occur in an electrically connected region or the like where a large current flows.

Moreover, a connector-mounted part 208 is formed inside the aluminum case 202, and the terminals 206 are integrally provided on the connector-mounted part 208 by way of a connecting connector 210.

As patent literatures concerning the related art, Patent Literatures 1 and 2, for example, should be referred to.

CITATION LIST

Patent Literature

Patent Literature 1: JP-A-2004-327169
Patent Literature 2: JP-A-2006-48998

SUMMARY OF THE INVENTION

Technical Problem

In order to provide a locking part for reliably holding the packing 204 in the aluminum case 202, it is necessary to provide, for example, a hole or a locking beak in the aluminum case 202. In this case, an undercut part occurs in the aluminum case 202, and for the purpose of coping with this undercut part, it is necessary to set a die in the molds, which will make structure of the molds complicated.

Moreover, because the interior of the aluminum case 202 must be reliably waterproofed, it is difficult to form a hole for securing the packing 204, in the aluminum case 202 in which the terminals 206 are provided.

Therefore, in the connector 200 in the related art, it is difficult to secure and hold the packing 204, and there is such a problem that the packing 204 may be detached from the aluminum case 202, while the connector 200 is removed from the inverter (an electrical device) (including an occasion where the connector 200 is packed for transportation).

The invention has been made in view of the above described problems, and it is an object of the invention to provide a connector of which an interior can be waterproofed, and also, detachment of a packing from a case, while the connector is removed from an electrical device, can be prevented.

Solution to Problem

An aspect of the invention corresponds to a connector, including: a packing which includes: a packing body part formed in an annular shape; at least a pair of ear parts extending outward from the packing body part; and lock receiving parts which are provided in the ear parts; and a case which includes: a case body part which is provided with an opening; a packing-mounted part formed in an annular shape which is provided around the opening of the case body part and on which the packing body part is mounted; a flange part which is integrally provided on the case body part to surround the packing-mounted part; at least a pair of through holes which are formed in the case body part to communicate between a face of the packing-mounted part where the packing body part is mounted and a back face of the flange part, and through which the ear parts are respectively passed; and at least a pair of locking parts which are provided on the back face of the flange part and with which the lock receiving parts in the ear parts are respectively engaged.

An aspect of the invention corresponds to the connector, wherein the lock receiving parts in the pair of ear parts are formed as through holes, and the pair of locking parts of the case are formed as projections passing the respective through holes, a distance between a pair of the projections is set to be larger than a distance between a pair of the through holes, while the packing is separate from the case, and the packing is configured to be elastically deformed between the pair of through holes, when the packing is mounted on the case, whereby tensile stress occurs in the packing.

An aspect of the invention corresponds to the connector, wherein the packing body part is formed in an oblong shape, and the respective ear parts are provided in both end areas of the packing body part in a longitudinal direction.

Advantageous Effect of the Invention

According to the aspects of the invention, it is advantageously possible to provide a connector of which an interior can be waterproofed, and at also, detachment of a packing from a case, while the connector is removed from an electrical device, can be prevented.

DESCRIPTION OF THE EMBODIMENTS

Figure 1:
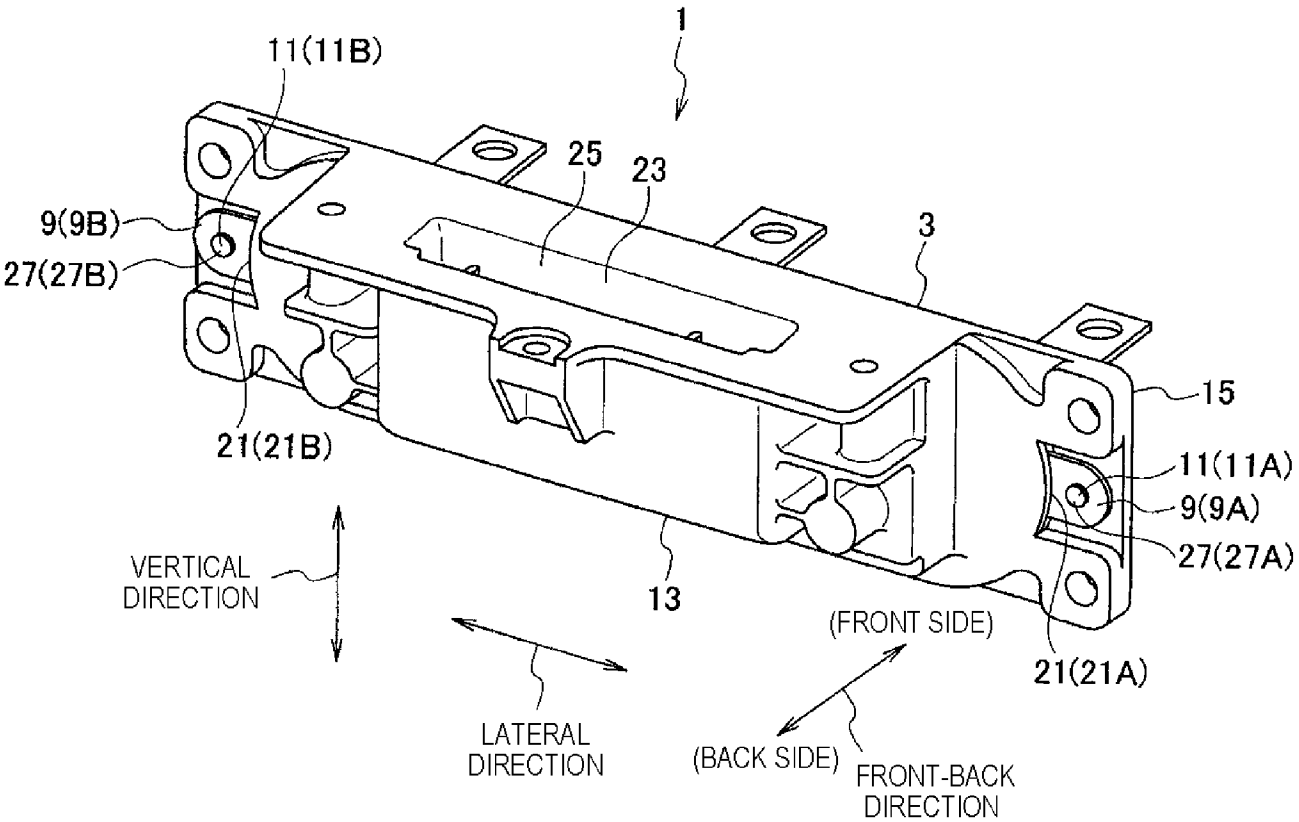
FIG. 1 is a perspective view showing a schematic structure of a connector as seen diagonally from the back according to an embodiment of the invention.
Figure 2:
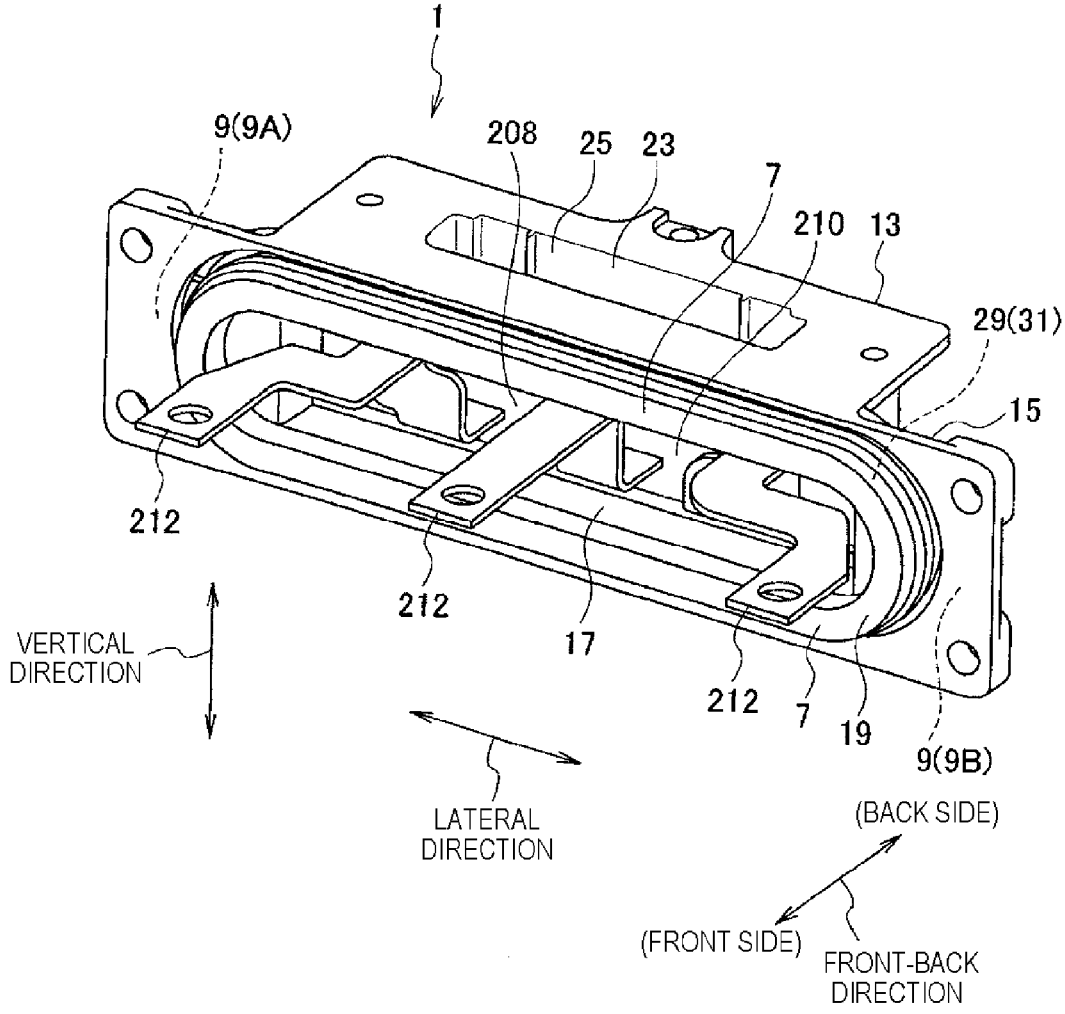
FIG. 2 is a perspective view showing the schematic structure of the connector as seen diagonally from the front.
Figure 3:
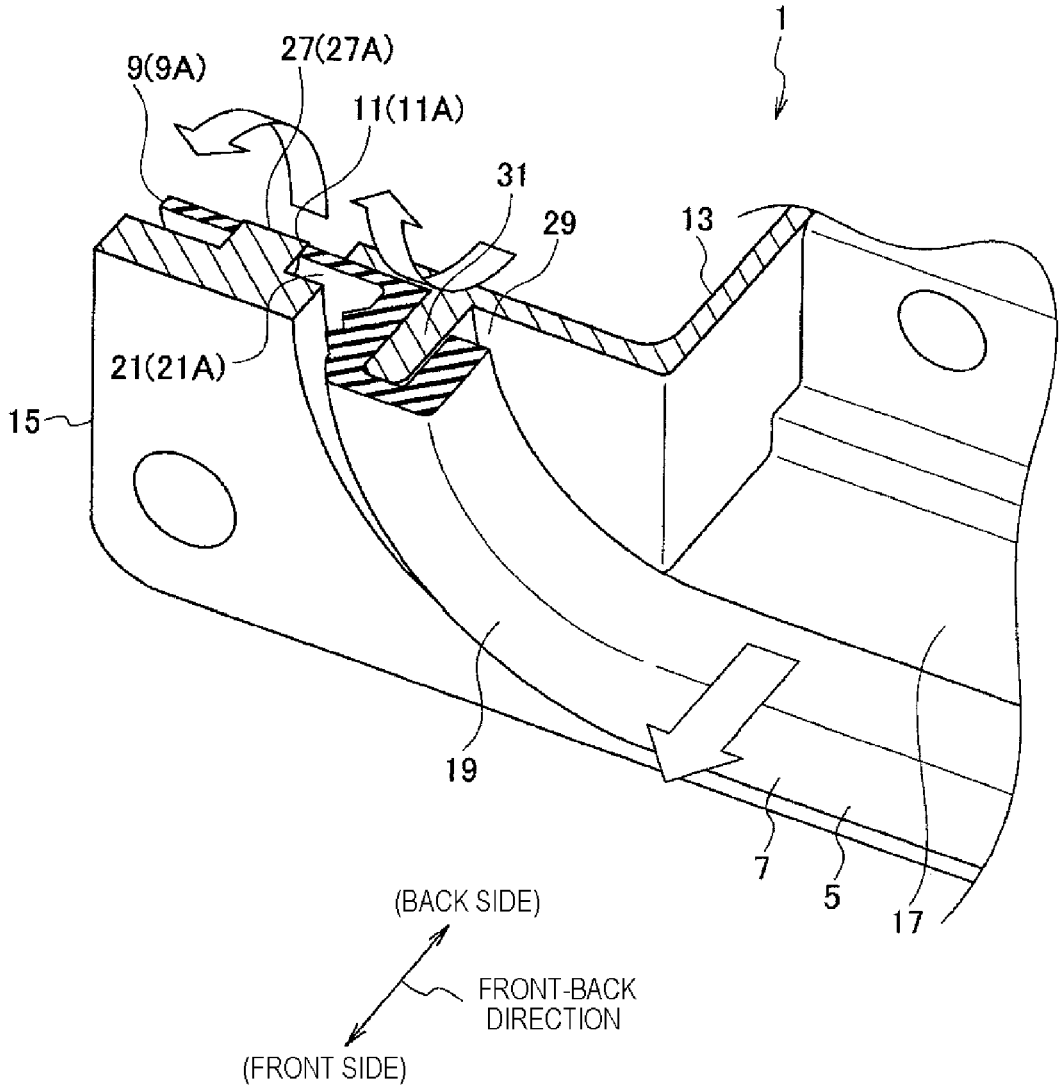
FIG. 3 is a diagram showing a part of the connector in cross-section.
Figure 4:
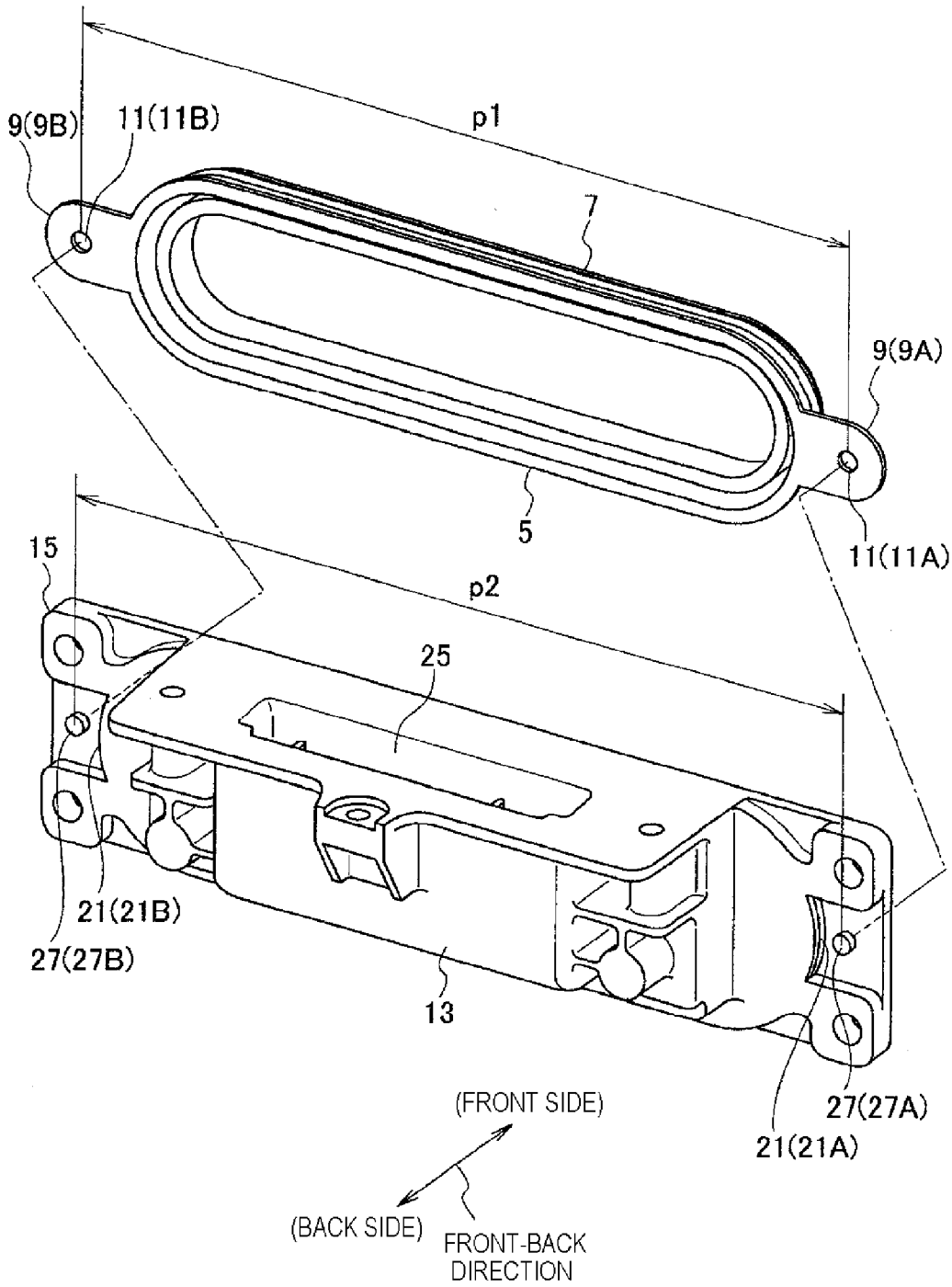
FIG. 4 is a perspective view showing the connector in a state where a packing is detached from a case, where the case and the packing is seen diagonally from the back.
Figure 5:
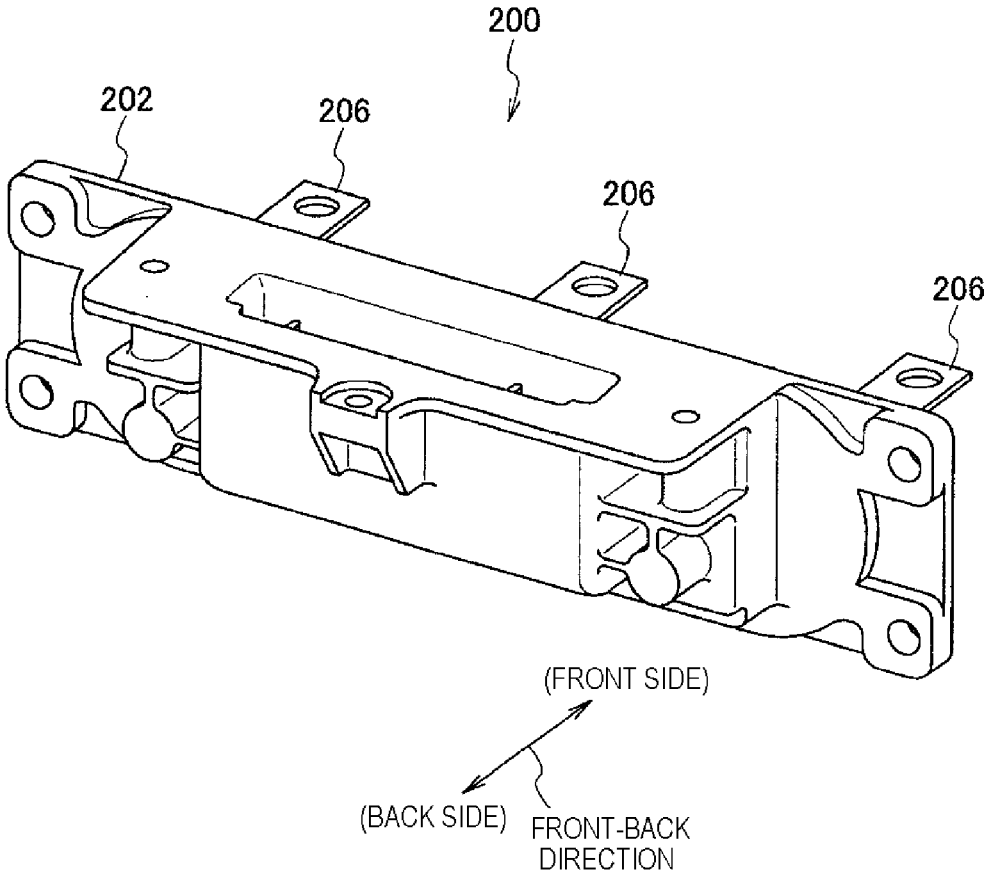
FIG. 5 is a perspective view of a connector in a related art as seen diagonally from the back.
Figure 6:
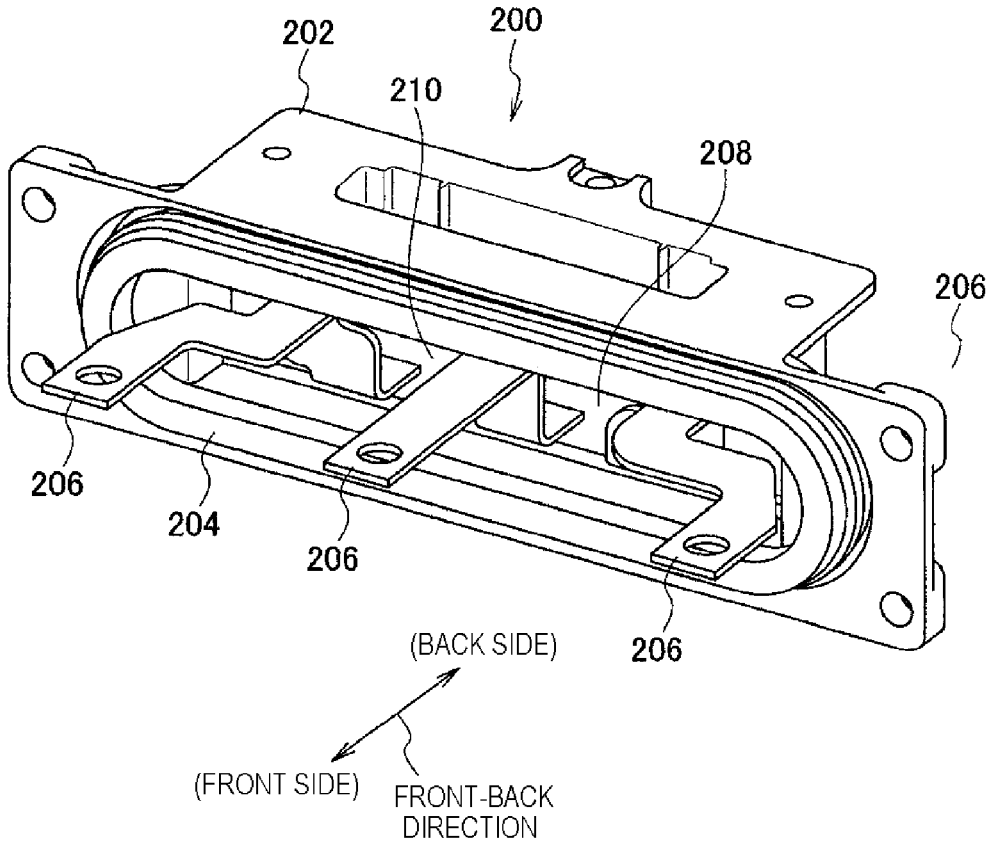
FIG. 6 is a perspective view of the connector in the related art as seen diagonally from the front.
Figure 7:
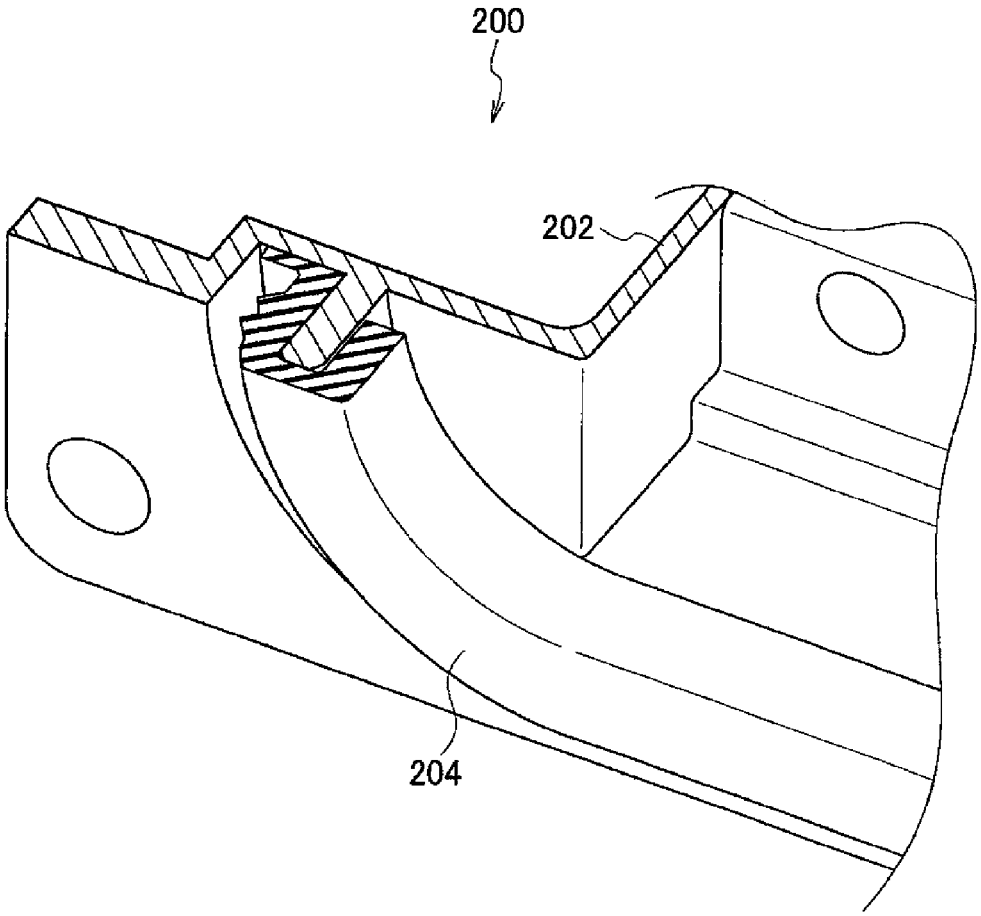
FIG. 7 is a perspective view of the connector in the related art in cross-section.

FIG. 1 is a perspective view showing a schematic structure of a connector 1 as seen diagonally from the back according to an embodiment of the invention. FIG. 2 is a perspective view showing the schematic structure of the connector 1 as seen diagonally from the front. FIG. 3 is a diagram showing a part of the connector 1 in cross-section. FIG. 4 is a perspective view showing the connector 1 in a state where a packing 5 is detached from a case 3, where the case 3 and the packing 5 is seen diagonally from the back.

The connector 1 is a connector for inverter which is directly attached to an inverter of an HEV, for example, in the same manner as the connector 200 in the related art. The connector 1 includes the case 3 and the packing 5.

Herein, for convenience of explanation, one direction of the connector 1 (the case 3 and the packing 5) (or a direction which is perpendicular to a surface of a housing of the inverter, when the connector 1 is mounted on the inverter) is referred to as a front-back direction. Particularly, an inverter side of the connector 1 is referred to as a front side, and an opposite side to the inverter side is referred to as a back side. Moreover, a direction perpendicular to the front-back direction in which a plurality of terminals 212 are aligned is referred to as a lateral direction of the connector 1, and a direction perpendicular to both the front-back direction and the lateral direction, is referred to as a vertical direction of the connector 1.

The packing 5 is formed of elastic material such as rubber. The packing 5 includes a body part 7 formed in an annular shape, and a pair of ear parts 9 (9A, 9B) extending outward from the body part 7. It is to be noted that at least a pair of the ear parts 9 would be enough. Specifically, a plurality of ear parts 9 or a plurality of pairs of ear parts 9 may be provided.

The pair of ear parts 9 (9A, 9B) are provided with lock receiving parts 11 (11A, 11B) which are formed as through holes, for example, at respective tip end sides thereof.

The case 3 is formed of metal such as aluminum, aluminum alloy or material having high rigidity and electrical conductivity such as resin. and the case 3 includes a body part 13 and a flange part 15.

The body part 13 of the case 3 is formed in a shape of a square box and provided with an opening 17 at its front side. A packing-mounted part 19 formed in an annular shape on which the body part 7 of the packing 5 is mounted is provided around the opening 17.

The flange part 15 of the case 3 is annularly formed, for example, in a shape of a flat plate, and integrally formed with the body part 13 of the case 3 so as to surround the packing-mounted part 19 in the body part 13 (so as to surround the opening 17). It is to be noted that a direction of thickness of the flange part 15 in a shape of a flat plate is equal to the front-back direction of the case 3.

The body part 13 of the case 3 is provided with a pair of through holes 21 (21A, 21B) corresponding to the ear parts 9 of the packing 5. The through holes 21 are formed in side areas of the body part 13 (both side areas in the lateral direction) so as to communicate between a face of the packing-mounted part 19 on which the body part 7 of the packing 5 is mounted (more particularly, an inner face of a dented part of the packing-mounted part 19 provided in the body part 13 of the case 3 which is dented backward from a front face of the flange part 15) and a back face of the flange part 15 (a rear face: a face at an opposite side to a face of the flange part 15 in contact with a surface of a casing of the inverter, when the connector 1 is mounted on the inverter). The pair of ear parts 9 (9A, 9B) are respectively passed through the pair of through holes 21 (21A, 21B), so that tip end portions of the ear parts 9 reach the back face of the flange part 15.

It is to be noted that the connector 1 is provided with the connector mounting part 208, the connecting connector 210, and the terminals 212, in the same manner as the connector 200 in the related art.

Moreover, a part of side faces of the body part 13 of the case 3 in a box-like shape (one of the side faces in a vertical direction) is open (an opening 25 is formed), and continued to an interior of the body part 13 in a box-like shape. Accordingly, the connector-mounted part is formed within a through hole 23 which is formed in the body part 13 in the box-like shape. One end portions of the terminals which are disposed in the body part 13 in the box-like shape are projected from the opening 17 of the body part 13 in the box-like shape. In some cases, the other end portions of the terminals which are disposed in the body part 13 or electric wires connected to these other end portions may be projected or extended from the opening 25 which is provided in the side face of the body part 13 in the box-like shape (the side face positioned at one side in the vertical direction).

The flange part 15 is provided with a pair of locking parts 27 corresponding to the ear parts 9 of the packing 5 on the back face of the flange part 15. The locking parts 27 includes, for example, projections 27 (27A, 27B) projecting backward from the back face of the flange part 15. The projections 27 (27A, 27B) are respectively inserted into the through holes 11 (11A, 11B) in the ear parts 9 (9A, 9B) which are respectively passing though the through holes 21 (21A, 21B), and thus, the lock receiving parts of the packing 5 are engaged with the locking parts of the case 3.

Incidentally, in a state where the packing 5 is separate from the case 3, a distance (a pitch p2) between the pair of projections 27 (27A, 27B) is set to be slightly larger than a distance (a pitch p1) between the pair of through holes 11 (11A, 11B) which are formed in the packing 5 (See FIG. 4).

Thus, in a state where the packing 5 is mounted on the case 3, the packing 5 is elastically deformed between the pair of through holes 11 (11A, 11B), and tensile stress occurs in the packing 5.

The body part 7 of the packing 5 is formed in an oblong shape, and the packing-mounted part 19 is also formed in an oblong shape. The ear parts 9 (9A, 9B) are provided in both end areas of the body part 7 of the packing 5 in the longitudinal direction.

The body part 7 of the packing in an oblong annular shape is formed by connecting both ends in the longitudinal direction of material formed in a band-like shape to each other. The material in the band-like shape is formed so that a section along a plane perpendicular to the longitudinal direction has a polygonal shape in a predetermined shape (for example, a polygonal shape in a C-shape in which an interior angle of a part is larger than 180 degree; it may be a round shape or an elliptical shape).

In the annular packing body part 7, an annular curve (for example, a curve in an oblong shape) which is formed by a trajectory of a center of the polygonal shape of the material in section is positioned on a substantially one plane. A rectilinear center axis of the annular packing body part 7 passes a center of the aforesaid annular curve, and extends in a direction perpendicular to the aforesaid one plane in which the annular curve exists (in the front-back direction, in a state where the packing 5 is mounted on the case 3).

The packing-mounted part 19 of the case 3 is formed in an oblong shape so as to surround the opening 17 (and the through hole 23) in the case 3. A longitudinal direction of the oblong packing-mounted part 19 is equal to the lateral direction of the connector 1. Moreover, the packing-mounted part 19 is dented backward from the front face of the flange part 15, and a bottom face 29 of the packing-mounted part 19 is formed as an annular flat face in an oblong shape having a predetermined width. An annular projection 31 in an oblong shape is provided so as to project from the bottom face 29 of the packing-mounted part 19 in front of the connector 1.

When the packing 5 (or the body part 7) is mounted on the packing-mounted part 19, the projection 31 enters into a recess in the packing body part 7 having a C-shape in section, and thus, the packing body part 7 is supported by the case 3. It is to be noted that the packing body part 7 slightly protrudes forward from the front face of the flange part 15.

Each of the ear parts 9 (9A, 9B) is formed in a shape of a flat plate having a rectangular base end portion and a semi-circular tip end portion. The respective ear parts 9 (9A, 9B) project from both ends of the packing body part 7 in the longitudinal direction of the oblong packing body part 7 so that a direction of their thickness may correspond to the front-back direction of the packing 5. Moreover, the ear parts 9 (9A, 9B) protrude from the packing body part 7 in rear of the packing 5.

In a state where the packing 5 is mounted on the packing-mounted part 19, the ear parts 9 (9A, 9B) pass through the through holes 21 (21A, 21B) of the case 3. On this occasion, respective one faces (front faces) of the ear parts 9 (9A, 9B) in the direction of thickness come into contact with the back face of the flange part 15, and the projections 27 (27A, 27B) formed in the flange part 15 pass through the through holes 11 (11A, 11B) which are formed in respective center parts of the semi-circular portions of the ear parts 9 (9A, 9B).

Next, steps for assembling (mounting) the packing 5 to the case 3 from the state where the packing 5 is separated from the case 3 will be described.

Firstly, the body part 7 of the packing 5 is mounted on the packing-mounted part 19. Thereafter, the ear part 9A is passed through the through hole 21A, and the ear part 9B is passed through the through hole 21B, and then, the projection 27A of the flange part 15 is passed through the through hole 11A in the ear part 9A, and the projection 27B of the flange part 15 is passed through the through hole 11B in the ear part 9B.

Specifically, a step for mounting the packing body part 7 on the packing-mounted part 19, a step for fitting the ear parts 9 (9A, 9B), and a step for engaging their lock receiving parts with the locking parts (the locking parts of the flange part 15) are not simultaneously conducted, but conducted in separate steps.

In a state where the center axis of the packing body part 7 extends in the front-back direction, and the packing 5 is separated from the case 3 to be positioned in front of the case 3, mounting of the packing body part 7 on the packing-mounted part 19 of the case 3 is performed, by moving the packing 5 backward so as to approach to the case 3.

Thereafter, as described above, the packing 5 is mounted on the case 3, by passing the ear parts 9 (9A, 9B) through the through holes 21 (21A, 21B), and by engaging the lock receiving parts of the ear parts 9 (9A, 9B) with the locking parts of the flange part 15.

Incidentally, in a state where the connector 1 is mounted on the inverter, both the front face of the flange part 15 and the packing body part 7 are in contact with the housing of the inverter. In this state, the packing body part 7 is elastically deformed in the front-back direction thereby to prevent intrusion of water into the case 3. Moreover, mounting the connector 1 on the inverter is performed, by passing a bolt through a through hole which is provided in the case 3.

According to the connector 1, the ear parts 9 (9A, 9B) of the packing 5 are passed through the through holes 21 (21A, 21B) which are provided near the packing-mounted part 19 of the case 3, and then, the lock receiving parts which are provided in the ear parts 9 (9A, 9B) of the packing 5 are engaged with the locking parts which are provided on the back face of the flange part 15 of the case 3 thereby to secure the packing 5 in the case 3. Therefore, it is possible to waterproof the interior of the connector 1 (or the interior where the terminals are provided), and also, to prevent the packing 5 from being detached from the case 3, while the connector 1 is removed from an electrical device such as the inverter.

Specifically, the packing 5 is fixed to the case 3 by means of the pair of ear parts 9 (9A, 9B) which are positioned outside the packing body part 7, the back face of the flange part 15, the pair of locking parts, and the pair of lock receiving parts. Therefore, even though the packing 5 is likely to be detached forward from the case 3, the ear parts 9 (9A, 9B) of the packing 5 are hooked on the back face of the flange part 15 by means of the lock receiving parts of the packing 5 which are engaged with the locking parts of the case 3, in cooperation with the back face of the flange part 15, and thus, the packing 5 will not be detached forward from the case 3.

Moreover, when the packing 5 is mounted on the case 3, it would be sufficient that the packing body part 7 is mounted on the packing-mounted part 19 of the case 3, as a first step, and then, the ear parts 9 (9A, 9B) are passed though the through holes 21 (21A, 21B), thereby to engage the lock receiving parts with the locking parts. In this manner, the packing 5 can be easily mounted on the case 3.

Moreover, according to the connector 1, because the tensile stress occurs in the packing 5 between the lock receiving parts (or the through holes 11A, 11B), it is possible to prevent slack of the packing 5 which is mounted on the case 3. Further, it is possible to prevent deformation of the packing body part 7 by being twisted or so, when the connector 1 is mounted in the housing of the electrical device or when mounting is finished. In this manner, waterproof property can be more reliably secured.

Moreover, according to the connector 1, because the pair of ear parts 9 (9A, 9B) are provided in both end areas of the packing body part 7 in the longitudinal direction, the tensile stress is stably applied to the packing 5. In this manner, it is possible to more reliably prevent slack of the packing 5.

Although aspects of the invention have been described in detail, referring to the specific embodiment, it is apparent to those skilled in the art that various changes or modifications can be added without deviating from the spirit and scope of the invention.

The present application is based on Japanese Patent Application (No. 2009-201643) filed on Sep. 1, 2009, the contents of which is hereby incorporated by reference.

REFERENCE SIGNS LIST

1 Connector
3 Case
5 Packing
7 Body part (of the packing)
9, 9A, 9B Ear part
11, 11A, 11B Lock receiving part (through hole)
13 Body part (of the case)

15 Flange part
17 Opening
19 Packing-mounted part
21, 21A, 21B Locking part (projection)
p1, p2 Distance

The invention claimed is:

1. A connector, comprising:

a packing which includes:

a packing body part formed in an annular shape;

at least a pair of ear parts extending outward from the packing body part; and lock receiving parts which are provided in the ear parts; and a case which includes:

a case body part which is provided with an opening;

a packing-mounted part formed in an annular shape which is provided around the opening of the case body part and on which the packing body part is mounted;

a flange part which is integrally provided on the case body part to surround the packing-mounted part;

at least a pair of through holes which are formed in the case body part to communicate between a face of the packing-mounted part where the packing body part is mounted and a back face of the flange part, and through which the ear parts are respectively passed; and at least a pair of locking parts which are provided on the back face of the flange part and with which the lock receiving parts in the ear parts are respectively engaged, wherein a distance between the pair of locking parts is set to be larger than a distance between the lock receiving parts, while the packing is separate from the case, and the packing is configured to be elastically deformed between the lock receiving parts, when the packing is mounted on the case, whereby tensile stress occurs in the packing.

2. The connector according to claim 1, wherein the lock receiving parts in the pair of ear parts are formed as through holes, and the pair of locking parts of the case are formed as projections passing the respective through holes.

3. The connector according to claim 2, wherein the packing body part is formed in an oblong shape, and the respective ear parts are provided in both end areas of the packing body part in a longitudinal direction.

4. The connector according to claim 1, further comprising a projection that projects from a bottom face of the packing-mounted part, wherein the packing body part includes a recess, and the projection is provided within the recess.

5. The connector according to claim 4, where the projection has an annular shape.

* * * * *